US006832413B1

(12) United States Patent
Applewhite et al.

(10) Patent No.: US 6,832,413 B1
(45) Date of Patent: Dec. 21, 2004

(54) REFORMABLE HANDLE

(75) Inventors: John T. Applewhite, Marietta, GA (US); Reynaldo Aratea, Atlanta, GA (US)

(73) Assignee: Johnson Research & Development Company, Inc., Atlanta, GA (US)

( * ) Notice: Subject to any disclaimer, the term of this patent is extended or adjusted under 35 U.S.C. 154(b) by 0 days.

(21) Appl. No.: 10/316,223

(22) Filed: Dec. 10, 2002

(51) Int. Cl.[7] ..... B25G 3/00; B25G 1/04

(52) U.S. Cl. ..... 16/430; 16/436; 16/DIG. 12; 16/DIG. 18

(58) Field of Search ..... 16/430, 436, 421, 16/443, DIG. 12, DIG. 18, DIG. 19; 74/551.9, 557; 15/143.1; 81/177.1, 177.3, 177.6, 489; 401/6, 7, 8; 473/551, 549, 568

(56) References Cited

U.S. PATENT DOCUMENTS

| | | | | | |
|---|---|---|---|---|---|
| 412,479 | A | * | 10/1889 | Davis | 264/271.1 |
| 2,205,769 | A | * | 6/1940 | Sweetland | 81/492 |
| 3,712,618 | A | | 1/1973 | Berzatzy | 273/75 |
| 3,748,779 | A | | 7/1973 | Cherk et al. | 46/115 |
| 3,868,110 | A | * | 2/1975 | Jones | 473/551 |
| 4,509,228 | A | * | 4/1985 | Landsberger | 16/426 |
| 4,617,697 | A | | 10/1986 | David | 16/110 |
| 4,696,842 | A | * | 9/1987 | Doubt | 428/41.3 |
| 4,719,063 | A | | 1/1988 | White | 264/45.2 |
| 4,765,865 | A | * | 8/1988 | Gealer et al. | 438/705 |
| 5,155,878 | A | | 10/1992 | Dellis | 16/111 |
| 5,355,552 | A | | 10/1994 | Huang | 16/111 |
| 5,713,104 | A | * | 2/1998 | Giampaolo, Jr. | 16/422 |
| 5,740,586 | A | | 4/1998 | Gomas | 16/111 |
| 5,846,145 | A | * | 12/1998 | Tinlin | 473/550 |
| 5,846,629 | A | | 12/1998 | Gwinn | 428/68 |
| 5,848,946 | A | | 12/1998 | Stillinger | 473/594 |
| 5,970,581 | A | * | 10/1999 | Chadwick et al. | 16/421 |
| 5,984,795 | A | * | 11/1999 | Stafford | 473/206 |
| 6,148,483 | A | * | 11/2000 | DeGraff | 16/430 |
| 6,314,617 | B1 | | 11/2001 | Hastings | 16/436 |
| 6,647,582 | B1 | * | 11/2003 | Rechelbacher | 15/143.1 |

FOREIGN PATENT DOCUMENTS

| | | | | |
|---|---|---|---|---|
| DE | 4446727 A1 | * | 6/1995 | A45D/24/36 |
| EP | 117333 A | * | 9/1984 | A63B/59/00 |

* cited by examiner

*Primary Examiner*—Chuck Y. Mah
(74) *Attorney, Agent, or Firm*—Baker Donelson

(57) ABSTRACT

There is shown a reformable handle (10) having an air pump (12), partially surrounded by a covering (13) so as to define a chamber (17) which contains a mass of filler material (18). The handle may be reformed into another configuration by a person firmly grasping the handle (10) so as to deform the covering (13) to conform with the person's grip and evacuating the air from within the chamber (17). The removal of air from within the chamber causes the covering to constrict about the filler material thereby locking the filler material in place. The handle may later be reconfigured by actuating a pressure release valve (44) which allows the return of air into the chamber. Once air is returned the filler material may be reconfigured and the pump actuated again to re-evacuate the chamber and once again reform the handle.

16 Claims, 2 Drawing Sheets

REFORMABLE HANDLE

TECHNICAL FIELD

This invention relates to handles, and specifically to handles for devices that can be reformed to conform to a user's grip.

BACKGROUND OF THE INVENTION

Handles have existed in many forms over the years. Most handles, such as those commonly found on tools such as screwdrivers, hammers or power tools, have a round or square handle in cross-section. While these general shapes provide some gripping capabilities they do not provide an optimal gripping configuration. Furthermore, some handicapped people or people with medical problems, such as arthritis, have trouble grasping items with these commonly shaped handles.

To provide enhanced gripping capabilities devices have been designed with moldable handles. As shown in U.S. Pat. Nos. 4,617,697, 4,719,063 and 5,155,878, handles have been designed to include an inner mass of material which is converted from a pliable or moldable state to a solid or resilient state. This change in the physical state may be accomplished through the use of thermoplastics or the like. A user simply grips the handle while the material is in the pliable state to reconfigure the material, which is then allows it to harden over time to its hardened state. While this approach provides a custom grip, once it has been reformed the material can not later be changed. If the user does not like the manner in which the handle has been formed he cannot reform the handle to a more preferred form. Also, should a different user wish to utilize the tool he will find that the handle does not conform to his grip and that he cannot change the form of the hardened grip.

Handles have also been designed to include repositionable, movable elements, as shown in U.S. Pat. No. 6,314,617. These handles include a linear series of interior disks that can be moved relative to a central rod to change the overall shape of the handle. Once the disks are positioned to conform with the person's hand a locking mechanism is actuated to lock the relative position of the disks. The configuration of the handle however is greatly limited and does not conform to the small variations in a person's grip. Therefore, these handles have proven to be inadequate in providing a truly custom grip.

Accordingly, it is seen that a need remains for a handle which may to reconfigured to one's grip but which may also be later reconfigured again. It is to the provision of such therefore that the present invention is primarily directed.

SUMMARY OF THE INVENTION

In a preferred form of the invention a reformable handle is shown which may be coupled to device. The handle comprises a flexible, air impermeable, outer covering at least partially defining a grip portion, a mass of filler material contained within the grip portion, and air pressure reducing means for reducing the air pressure within the grip portion. With this construction, a person may grip and therefore deform the outer covering to conform to the configuration of the person's hand and simultaneously actuate the air pressure reducing means so as to reduce the quantity of air within the mass of filler material thereby causing the outer covering to constrict and lock the mass of filler material in place, the locking of the filler material thereby causing the grip portion to remain in its deformed configuration conforming to the person's hand.

DETAILED DESCRIPTION

Figure 1:
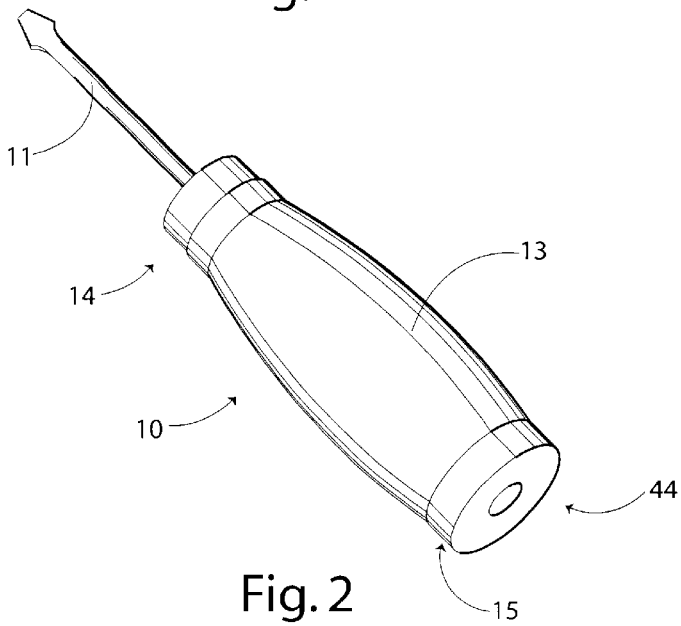
FIG. 1 is a perspective view of a reformable handle embodying principles of the present invention in a preferred form.

With reference next to the drawings, there is shown a reformable handle 10, in a preferred form of the invention, shown coupled to a working device shown herein as the driving end of a screwdriver 11. The handle 10 has a generally central, rigid manual air pump 12 at least partially surrounded by a flexible, tubular, air-impermeable covering 13. The covering 13 is sealed in an air-tight manner to the air pump 12 by a first annular, sealing end 14 and a second annular, sealing end 15. The covering 13 is spaced from the air pump 12 to define a tubular chamber 17 therebetween which is filled with a mass of filler material 18 in the form of pellets. The covering 13, first sealing end 14, and second sealing end 15 generally form a grip portion of the handle 10.

Figure 2:
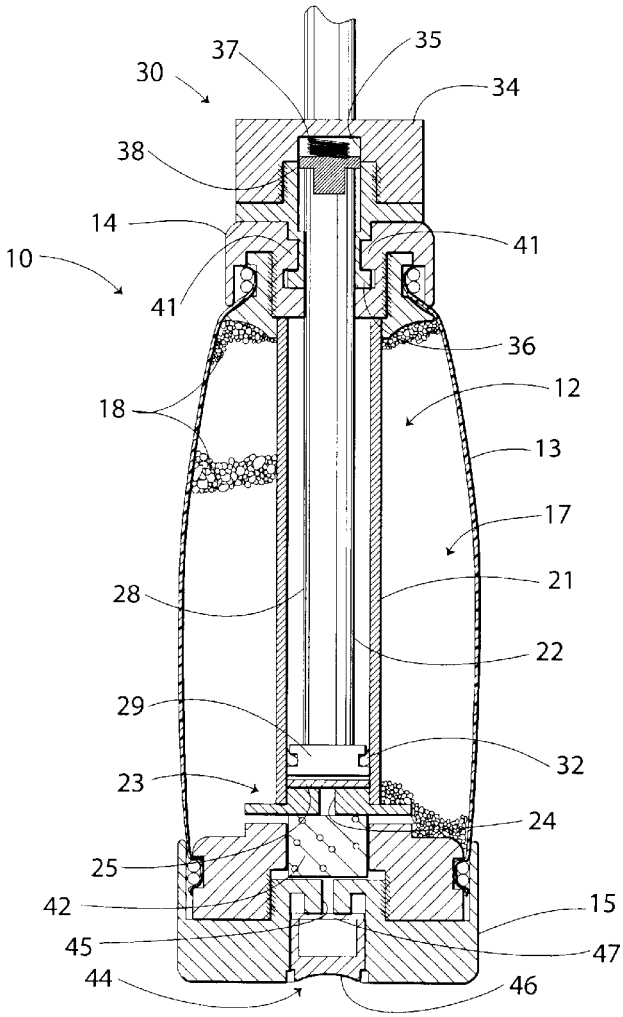
FIGS. 2–4 are a sequence of side views showing the reformable handle of FIG. 1, which show in sequence, the reformation of the handle.
Figure 3:
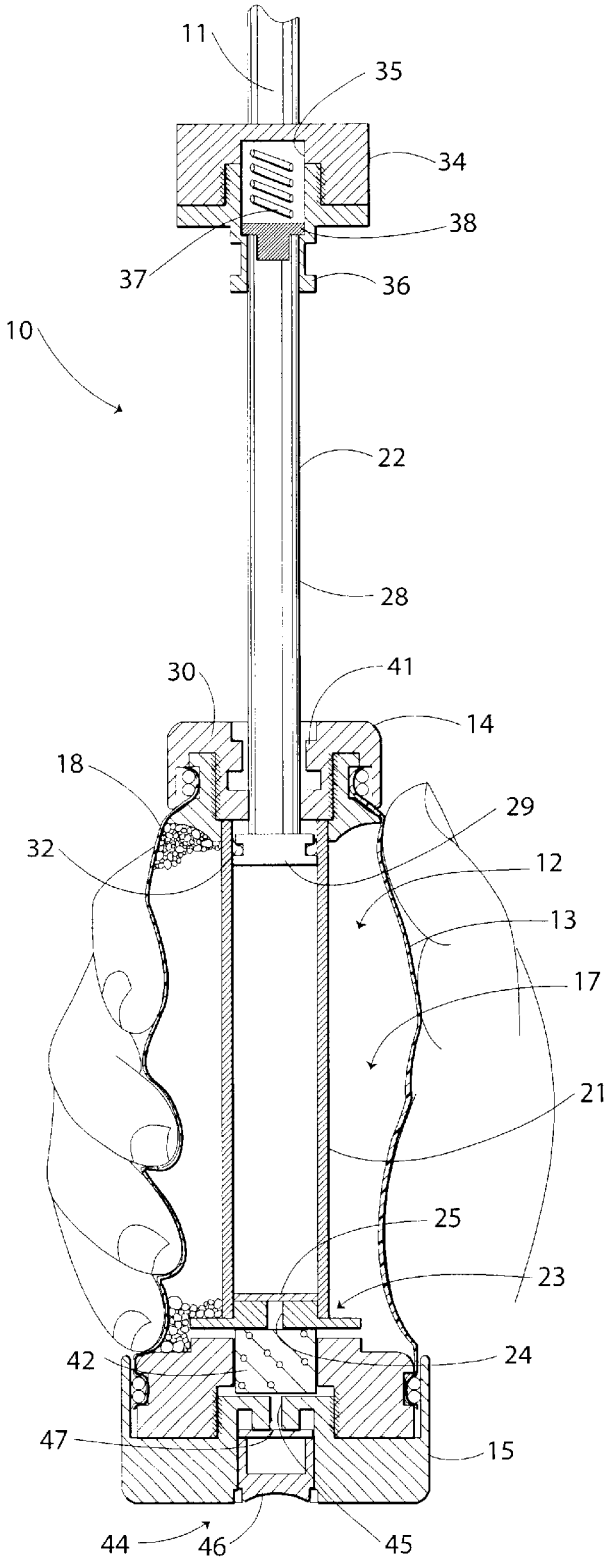
Figure 4:
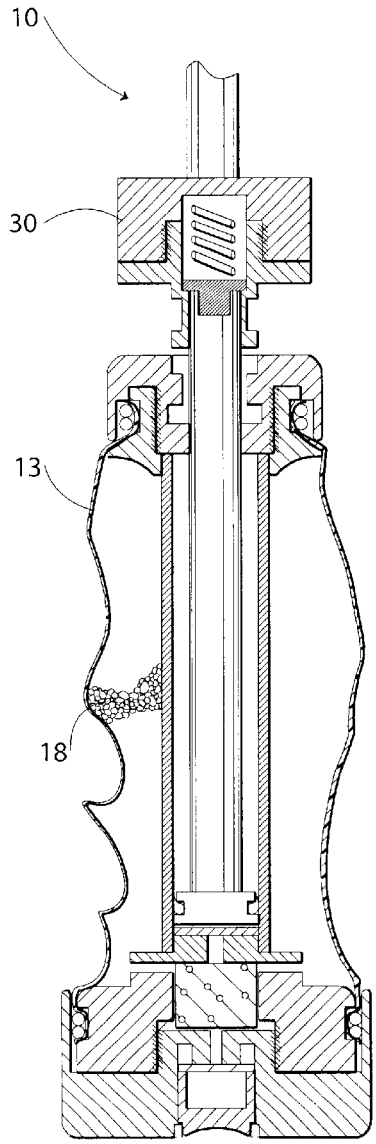

The air pump 12 includes a tubular cylinder 21 and a moveable piston 22 mounted for reciprocal movement within the cylinder 21 between a fully collapsed position, shown in FIG. 2 or a partially collapsed position, shown in FIG. 4, and an extended position, shown in FIG. 3. The air pump 12 has a distal end 23 with an opening 24 therethrough which allows the passage of air into the cylinder 21 and a rubber check valve 25 which allows the passage of air into the cylinder 21 but prevents the passage of air out of the cylinder through opening 24. The moveable piston 22 has an elongated shaft 28 with a sealing end 29 and a stop end 30 opposite the sealing end 29.

The sealing end 29 has a conventional annular O-ring type seal 32 which is designed to prevent the passage of air between the seal 32 and the interior surface of the cylinder 21 when the piston 22 is moved from its collapsed position to its extended position, but which allows the passage of air between the seal 32 and the interior surface of the cylinder 21 when the piston is moved from its extended position to its collapsed position.

The stop end 30 has a mounting collar 34 with a central passage 35 in which the shaft 28 is slidably coupled for reciprocal movement. The collar 34 has an exterior flange 36 and a spring 37 mounted within the passage 35 which biases the shaft 28 in a direction out of passage 35. The shaft 28 however has a stop 38 which prevents the shaft from being removed from the collar 34. The screwdriver 11 driving end is shown mounted to the stop end 30.

The first sealing end 14 is designed to capture and seal one end of the tubular covering 13, as best shown in FIG. 24. The first sealing end 14 also has an interior flange 41 sized and shaped to releasably mate with the exterior flange 36 of stop end 30. The second sealing end 15 is similarly designed to capture and seal an opposite end of the tubular covering 13. The second sealing end 15 also includes a filter block 42 of air permeable foam which is selected to allow the passage of air therethrough but prevent the passage of the filler material 18 therethrough. The second sealing end 15 also includes a pressure release valve 44 which allows the passage of air into the chamber 17 through an opening 45 upon manual actuation of the pressure release valve 44. The pressure release valve 44 may be in the form of a planar, rubber check valve 47 which is deformable to an unsealing configuration by a pressure button 46 which allows the passage of air thereby while in the deformed configuration.

In use, the stop end 30 is rotated relative to the first sealing end 14 so that the exterior flanges 36 of the stop end are disengaged from the interior flanges 41 of the first sealing ends. With the flanges 36 and 41 disengaged from each other and a person firmly grasping the handle 10 so as to deform the covering 13 to conform with the person's grip, as shown in FIG. 3, the air pump 12 is actuated to evacuate or withdraw air from within chamber 17. In actuating the air pump the piston 22 is moved from its collapsed position, shown in FIG. 4, to its extended position, shown in FIG. 3. This movement of the piston creates a low pressure zone or vacuum within the cylinder 21 which causes air to be withdrawn from the chamber 17. The withdrawn air passes from the chamber 17 through the filter block 42, through the opening 24, through the check valve 25, and into the cylinder 21 between the sealing end 29 of the piston and the distal end 23 of the pump. Any air captured within the cylinder between the piston sealing end 29 and the first sealing end 14 escapes to ambience between the piston shaft 28 and first sealing end 14. Return movement of the piston 22 from its extended position to its retracted position causes the air within the cylinder to flow past O-ring seal 32 into the portion of the cylinder between the piston sealing end 29 and first sealing end 14.

The evacuation of the air from within the chamber 17 causes air between the pellets to be withdrawn and the covering 13 to constrict against the mass of filler material 18. The constriction of the covering 13 locks the filler material 18 in place in substantially the form it has been positioned by the gripping force of the person's hand.

Once the chamber 17 is substantially evacuated of air the pump is returned to its fully contracted and locked position. This is accomplished by pushing the piston 22 into the cylinder 21 and rotating the stop end 30 so that its exterior flanges 36 engage and releasably lock with the interior flanges 41 of the first sealing end 14.

It should be understood that in order to allow the piston sealing end 29 to extend all the way to the distal end 23 of the pump while the stop end 30 is not forced into the first sealing end 14, spring 37 forces the piston shaft 28 outwardly from the stop end 30. The movement of the shaft 28 by the spring 37 effectively increases the length of the piston. However, the spring 37 is compressed and the shaft is forced into the stop end 30 when the stop end 30 is moved to its locked position, shown in FIG. 2.

Should the person utilizing the handle or another person entirely wish to reconfigure the handle the vacuum within the chamber must to released. In order to release the vacuum the operator simply actuates release valve 44 by depressing pressure button 46 so as to deform rubber check valve 47. The actuation of the release valve 44 allows ambient air to flow past the rubber check valve 47, through opening 45, through filter block 42 and into chamber 17. The return of air into the chamber 17 causes the covering 13 to expand and thereby unlock or decompress the mass of filler material, i.e., the return of air loosens the filler material so that it may once again become pliable.

It should be understood that the handle of the present invention may be utilized with virtually any device which includes a handle or grip, including but not limited to sports equipment such as golf clubs, bats and tennis rackets, hand tools such as screwdrivers, hammers, shovels, wrenches, and axes, power tools such as power saws, jack hammers, lawn mowers and drills, vehicle parts such as the handles of bicycles, stick shifts or steering wheels, household items such as vacuum cleaners, mops and brooms, and carrying items such as suitcases. The device may be coupled to the stop end, as shown in the drawings, or alternatively may be coupled to the second sealing end. It should also be understood that the device to which the handle 10 is coupled may be mounted in any conventional fashion, such as by welding, glueing, brackets, fasteners, threaded posts, male and female couplers, internal or external threads within or about one of the ends of the handle and other similar mounting means.

Also, when used in connection with a power tool the means for reducing the pressure within the chamber may be a mechanical air pump. The mechanical air pump may be driven by the motor of the power tool. Also, the air reducing mechanism of the handle may be an air reducing mechanism of the device, such as the mechanism of a vacuum cleaner, i.e., a vacuum may be siphoned from another mechanism which creates a vacuum.

It should be understood that any type of pellet may be used as the filling material, such as sand, seeds, small balls, ground material, foam rubber, powders, or the like.

Also, the exterior covering 13 may be any material which is flexible and impermeable to air, such as a layer of latex, rubber, vinyl or other plastic material.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

1. A reformable handle which may be coupled to a device, said handle comprising, a flexible, air impermeable, outer covering at least partially defining a handle grip portion;

a mass of filler material contained within said grip portion, and air pressure reducing means for reducing the air pressure within said grip portion, whereby a person may grip and therefore deform the outer covering to conform to the configuration of the person's hand and simultaneously actuate the air pressure reducing means so as to reduce the quantity of air associated with the mass of filler material thereby causing the outer covering to constrict and lock the mass of filler material in place, the locking of the filler material thereby causing the grip portion to remain in its deformed configuration conforming to the person's hand.

2. The reformable handle of claim 1 wherein said air pressure reducing means is an air pump.

3. The reformable handle of claim 1 further comprising an interior support member which supports said grip portion.

4. The reformable handle of claim 3 wherein said air pressure reducing means is an air pump and wherein said air pump is also said interior support member.

5. The reformable handle of claim 1 further comprising an air release valve, whereby the actuation of the air release valve allows air to flow back into the grip portion.

6. The reformable handle of claim 1 wherein said mass of filler material is a mass of pellets.

7. The reformable handle of claim 1 further comprising mounting means for mounting said grip portion to the device.

8. A reformable handle which may be coupled to a device, said handle comprising, a generally rigid support member;

a flexible, air impermeable, outer covering at least partially overlying said support member so as to form a chamber;

a mass of filler material contained within said chamber; and air pressure reducing means for reducing the air pressure within said chamber, whereby a person may grip and therefore deform the outer covering to conform to the configuration of the person's hand and simultaneously actuate the air pressure reducing means so as to reduce the quantity of air within the chamber thereby causing the outer covering to constrict and lock the mass of filler material in place causing the grip portion to remain in its deformed configuration conforming to the person's hand.

9. The reformable handle of claim 8 wherein said air pressure reducing means is an air pump.

10. The reformable handle of claim 8 wherein said air pressure reducing means is an air pump and wherein at least a portion of said air pump is said support member.

11. The reformable handle of claim 8 further comprising an air release valve, whereby the actuation of the air release valve allows air to flow back into the chamber.

12. The reformable handle of claim 8 wherein said mass of filler material is a mass of pellets.

13. The reformable handle of claim 8 further comprising mounting means for mounting said support member to the device.

14. A reformable handle which may be coupled to a device, said handle comprising, an air pump;

a flexible, air impermeable, outer covering positioned at least partially about said air pump so as to define a chamber;

a mass of filler material contained within said chamber; and coupling means for coupling said chamber to the device, whereby a person may grip and therefore deform the outer covering to conform to the configuration of the person's hand and simultaneously actuate the air pump so as to reduce the quantity of air within the chamber thereby causing the outer covering to constrict and lock the mass of filler material in place causing the outer covering to remain in its deformed configuration conforming to the person's hand.

15. The reformable handle of claim 14 further comprising an air release valve, whereby the actuation of the air release valve allows air to flow back into the chamber.

16. The reformable handle of claim 14 wherein said mass of filler material is a mass of pellets.

* * * * *